US011976559B1

(12) United States Patent
Barberger et al.

(10) Patent No.: US 11,976,559 B1
(45) Date of Patent: May 7, 2024

(54) ROTOR FOR A ROTARY ENGINE

(71) Applicant: Pratt & Whitney Canada Corp., Longueuil (CA)

(72) Inventors: Jérémie Barberger, Montreal (CA); Michel Bousquet, Longueuil (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 18/132,155

(22) Filed: Apr. 7, 2023

(51) Int. Cl.
*F01C 21/08* (2006.01)
*F01C 1/22* (2006.01)
*F01C 21/04* (2006.01)

(52) U.S. Cl.
CPC ..... *F01C 21/08* (2013.01); *F01C 1/22* (2013.01); *F01C 21/04* (2013.01)

(58) Field of Classification Search
CPC ..... F01C 21/08; F01C 1/22; F01C 21/04
USPC ..... 123/18 A, 18 R, 43 A, 45 A, 45 R, 123/200–249; 418/140, 187, 61.1; 60/39.55
See application file for complete search history.

(56) References Cited

U.S. PATENT DOCUMENTS 3,102,682 A * 9/1963 Paschke ..... F01C 21/06 418/91
3,176,915 A * 4/1965 Bentele ..... F01C 1/22 418/94
3,204,614 A 9/1965 Huber
3,269,370 A * 8/1966 Paschke ..... F02B 55/04 418/94
3,405,694 A * 10/1968 Zimmermann ..... F02B 55/04 123/220
3,799,706 A * 3/1974 Bilobran ..... F01C 21/08 418/142
3,920,359 A * 11/1975 Gray ..... F01C 1/22 418/91
3,969,049 A * 7/1976 Hermes ..... F01C 19/08 418/91
3,999,905 A * 12/1976 Goloff ..... F01C 19/04 418/94
8,424,504 B2 4/2013 Garside
9,932,841 B2 4/2018 Staroselsky
10,000,308 B1 * 6/2018 Kelso ..... B65C 9/1826
(Continued)

FOREIGN PATENT DOCUMENTS

AT 510736 T 6/2011
CN 217270339 U 8/2022
(Continued)

*Primary Examiner* — J. Todd Newton
(74) *Attorney, Agent, or Firm* — Getz Balich LLC

(57) ABSTRACT

A rotor for an aircraft rotary engine includes a rotor body. The rotor body extends about an axial centerline. The rotor body includes an outer body portion, an annular inner body portion, and ribs. The outer body portion forms a plurality of sides and a plurality of apex portions of the rotor. The annular inner body portion is disposed radially inward of the outer body portion. The ribs extend radially between and connect the outer body portion and the annular inner body portion. The rotor body forms at least a first lubrication passage within the inner body portion and within a first rib of the ribs. The first lubrication passage includes at least one passage inlet and at least one passage outlet. The at least one passage inlet is disposed at the annular inner body portion.

13 Claims, 9 Drawing Sheets

(56) References Cited

U.S. PATENT DOCUMENTS

| | | | | |
|---|---|---|---|---|
| 11,459,890 | B2 | 10/2022 | Richmond | |
| 2018/0141127 | A1* | 5/2018 | Richard | B23K 26/342 |

FOREIGN PATENT DOCUMENTS

| | | | |
|---|---|---|---|
| EP | 2735700 | A2 | 5/2014 |
| GB | 927585 | A | 5/1963 |

* cited by examiner

ROTOR FOR A ROTARY ENGINE

TECHNICAL FIELD

This disclosure relates generally to rotary engines for aircraft and, more particularly, to a rotor for a rotary engine.

BACKGROUND OF THE ART

A rotary engine for an aircraft may be configured, for example, as a Wankel engine. The rotary engine may include one or more rotors configured eccentrically rotate within a rotor housing. Various rotor configurations are known for rotary engines. While these known rotors have various advantages, there is still room in the art for improvement.

SUMMARY

It should be understood that any or all of the features or embodiments described herein can be used or combined in any combination with each and every other feature or embodiment described herein unless expressly noted otherwise.

According to an aspect of the present disclosure, a rotor for an aircraft rotary engine includes a rotor body. The rotor body extends about an axial centerline. The rotor body includes an outer body portion, an annular inner body portion, and ribs. The outer body portion forms a plurality of sides and a plurality of apex portions of the rotor. Each side of the plurality of sides intersects each other side of the plurality of sides at one of the plurality of apex portions. The annular inner body portion is disposed radially inward of the outer body portion. The ribs extend radially between and connect the outer body portion and the annular inner body portion. The rotor body forms at least a first lubrication passage within the inner body portion and within a first rib of the ribs. The first lubrication passage includes at least one passage inlet and at least one passage outlet. The at least one passage inlet is disposed at the annular inner body portion.

In any of the aspects or embodiments described above and herein, the rotor body may further form the first lubrication passage within the outer body portion.

In any of the aspects or embodiments described above and herein, the at least one passage outlet may be disposed at the annular inner body portion.

In any of the aspects or embodiments described above and herein, the rotor body may form the first lubrication passage within the first rib and within at least one second rib of the ribs.

In any of the aspects or embodiments described above and herein, the at least one passage outlet may include a first passage outlet and a second passage outlet.

In any of the aspects or embodiments described above and herein, the first lubrication passage may include an inlet branch, a first outlet branch, and a second outlet branch. The inlet branch may extend from the at least one passage inlet to the first outlet branch and the second outlet branch. The first outlet branch may extend from the inlet branch to the first passage outlet. The second outlet branch may extend from the inlet branch to the second passage outlet.

In any of the aspects or embodiments described above and herein, the first lubrication passage may be disposed at a circumferential location of a respective one of the plurality of apex portions.

In any of the aspects or embodiments described above and herein, the ribs may include a cooled subset of the ribs and an uncooled subset of the ribs. The cooled subset of the ribs may form the first lubrication passage.

In any of the aspects or embodiments described above and herein, the annular inner body portion may form a bearing inner race of the rotor. The bearing inner race may include an inner race surface.

In any of the aspects or embodiments described above and herein, the bearing inner race may form a bearing lubricant channel within the inner race surface. The at least one inlet may be disposed at the bearing lubricant channel.

According to another aspect of the present disclosure, a rotary engine assembly for an aircraft includes a rotatable engine shaft and at least one rotor coupled to an eccentric portion of the rotatable engine shaft. Each rotor of the at least one rotor includes a rotor body extending about an axial centerline. The rotor body includes an outer body portion, an annular inner body portion, and ribs. The annular inner body portion is disposed radially inward of the outer body portion. The ribs extend radially between and connect the outer body portion and the inner body portion. The rotor body forms at least a first lubrication passage within the inner body portion and within a first rib of the ribs. The first lubrication passage includes at least one passage inlet and at least one passage outlet. The at least one passage inlet is disposed at the annular inner body portion.

In any of the aspects or embodiments described above and herein, the annular inner body portion may form a bearing inner race of the rotor. The bearing inner race may include an inner race surface facing the rotatable engine shaft.

In any of the aspects or embodiments described above and herein, the bearing inner race may form a bearing lubricant channel within the inner race surface. The at least one inlet may be disposed at the bearing lubricant channel.

In any of the aspects or embodiments described above and herein, the first lubrication passage may be formed by the first rib and at least one second rib of the ribs. The first lubrication passage may extend through the first rib and the at least one second rib from the at least one inlet to the at least one outlet.

In any of the aspects or embodiments described above and herein, the at least one passage outlet may be disposed at the annular inner body portion.

According to another aspect of the present disclosure a method for manufacturing a rotor for an aircraft rotary engine is provided. The method includes additively manufacturing the rotor with an additive manufacturing assembly. The additively-manufactured rotor includes a rotor body extending about an axial centerline. The rotor body includes an outer body portion, an annular inner body portion disposed radially inward of the outer body portion, and ribs. The ribs extend radially between and connect the outer body portion and the annular inner body portion. The rotor body forms at least a first lubrication passage within the inner body portion and within a first rib of the ribs. The first lubrication passage including at least one passage inlet and at least one passage outlet.

In any of the aspects or embodiments described above and herein, the rotor body may further form the first lubrication passage within the outer body portion.

In any of the aspects or embodiments described above and herein, the at least one passage inlet and the at least one passage outlet may be disposed at the annular inner body portion.

In any of the aspects or embodiments described above and herein, the at least one passage outlet may include a first passage outlet and a second passage outlet.

In any of the aspects or embodiments described above and herein, the first lubrication passage may include an inlet branch, a first outlet branch, and a second outlet branch. The inlet branch may extend from the at least one passage inlet to the first outlet branch and the second outlet branch. The first outlet branch may extend from the inlet branch to the first passage outlet. The second outlet branch may extend from the inlet branch to the second passage outlet.

The present disclosure, and all its aspects, embodiments and advantages associated therewith will become more readily apparent in view of the detailed description provided below, including the accompanying drawings.

DETAILED DESCRIPTION

Figure 1:
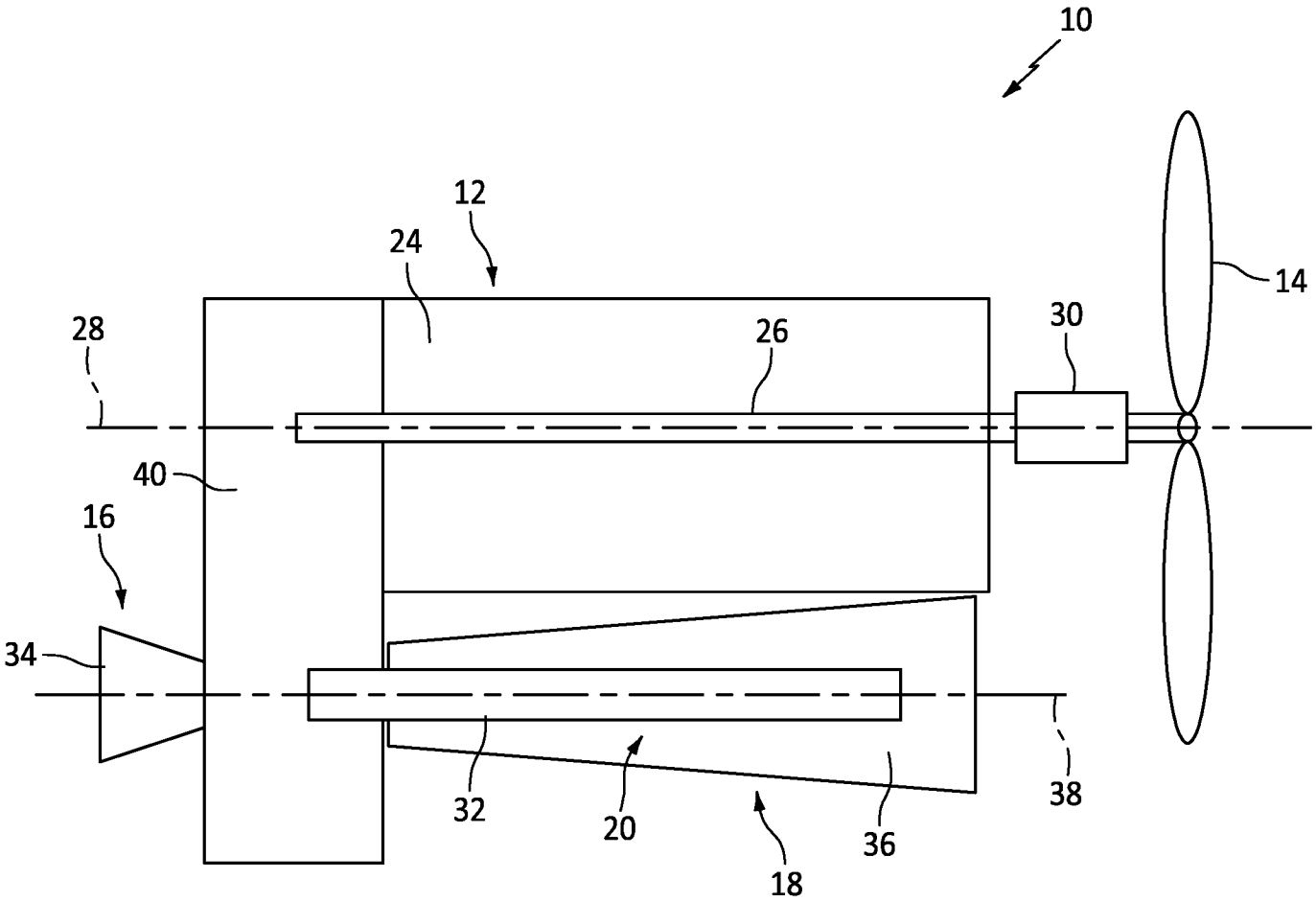
FIG. 1 illustrates a schematic view of an engine assembly, in accordance with one or more embodiments of the present disclosure.

FIG. 1 illustrates an engine assembly 10. The engine assembly 10 may form a portion of a propulsion system for an aircraft. Briefly, the aircraft may be a fixed-wing aircraft (e.g., an airplane), a rotary-wing aircraft (e.g., a helicopter), a tilt-rotor aircraft, a tilt-wing aircraft, or another aerial vehicle. Moreover, the aircraft may be a manned aerial vehicle or an unmanned aerial vehicle (UAV, e.g., a drone). The engine assembly 10 may also form a portion of an auxiliary power unit (APU) or onboard generator for an aircraft. However, the present disclosure is not limited to any particular application of the engine assembly 10. The engine assembly 10 of FIG. 1 includes an engine 12, a rotational load 14, a compressor section 16, a turbine section 18, a rotational assembly 20, and an engine control system 22.

The engine 12 of FIG. 1 is configured as a rotary intermittent internal combustion engine, which intermittent internal combustion engine includes a rotor assembly 24 and an engine shaft 26. As will be described in further detail, the rotor assembly 24 may be configured, for example, as a Wankel engine in which an eccentric rotor configuration is used to convert fluid pressure into rotational motion.

The rotor assembly 24 is coupled to the engine shaft 26 and configured to drive the engine shaft 26 for rotation about a rotational axis 28. The engine shaft 26 is coupled to the rotational load 14 such that rotation of the engine shaft 26 by the rotor assembly 24 drives rotation of the rotational load 14. The engine shaft 26 may be coupled to the rotational load 14 by a speed-reducing gear assembly 30 of the engine 12. The speed-reducing gear assembly 30 may be configured to effect rotation of the rotational load 14 at a reduced rotational speed relative to the engine shaft 26. The rotational load 14 of FIG. 1 is configured as a propeller. Rotation of the propeller by the engine 12 may generate thrust for an aircraft which includes the engine assembly 10. The engine assembly 10 of the present disclosure may additionally or alternatively be configured to drive other rotational loads, such as, but not limited to, an electrical generator(s), a rotational accessory load, a rotor mast, a compressor, or any other suitable rotational load configuration.

The rotational assembly 20 of FIG. 1 includes a shaft 32, a bladed compressor rotor 34 of the compressor section 16, and a bladed turbine rotor 36 of the turbine section 18. The shaft 32 interconnects the bladed compressor rotor 34 and the bladed turbine rotor 36. The shaft 32, the bladed compressor rotor 34, and the bladed turbine rotor 36 are mounted to rotation about a rotational axis 38. Ambient air is received by the compressor section 16. The air is compressed by rotation of the bladed compressor rotor 34 and directed to an air intake of the engine 12. Combustion exhaust gases from the engine 12 are directed to the turbine section 18 causing the bladed turbine rotor 36 to rotate and rotationally drive the rotational assembly 20. The engine shaft 26 and the rotational assembly 20 may be rotatably coupled by a gearbox 40 of the engine assembly 10, thereby allowing the engine 12 and/or the bladed turbine rotor 36 to rotationally drive the bladed compressor rotor 34. The present disclosure, however, is not limited to the particular engine 12 and rotational assembly 20 configuration of FIG. 1.

Figure 2:
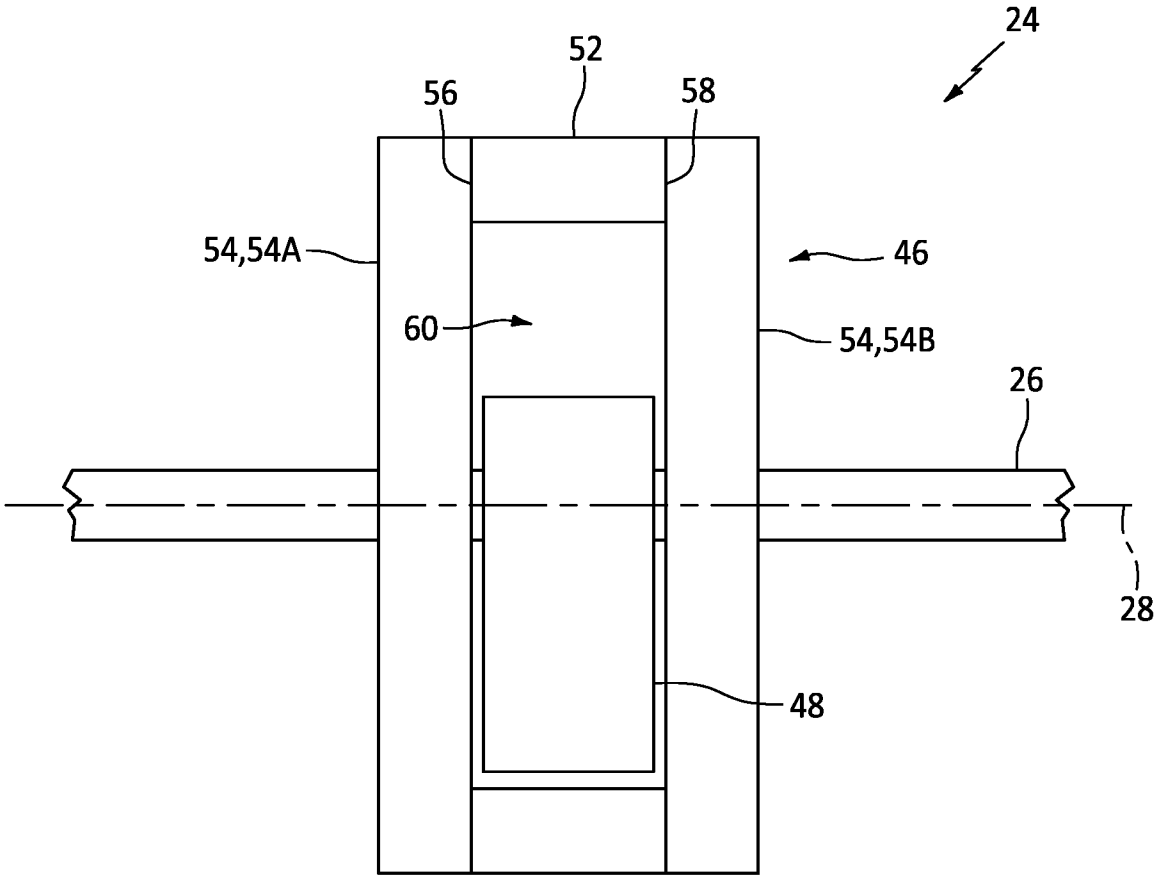
FIG. 2 illustrates a cutaway view of a rotor assembly for the engine assembly of FIG. 1 with additional portions of the engine assembly schematically illustrated, in accordance with one or more embodiments of the present disclosure.
Figure 3:
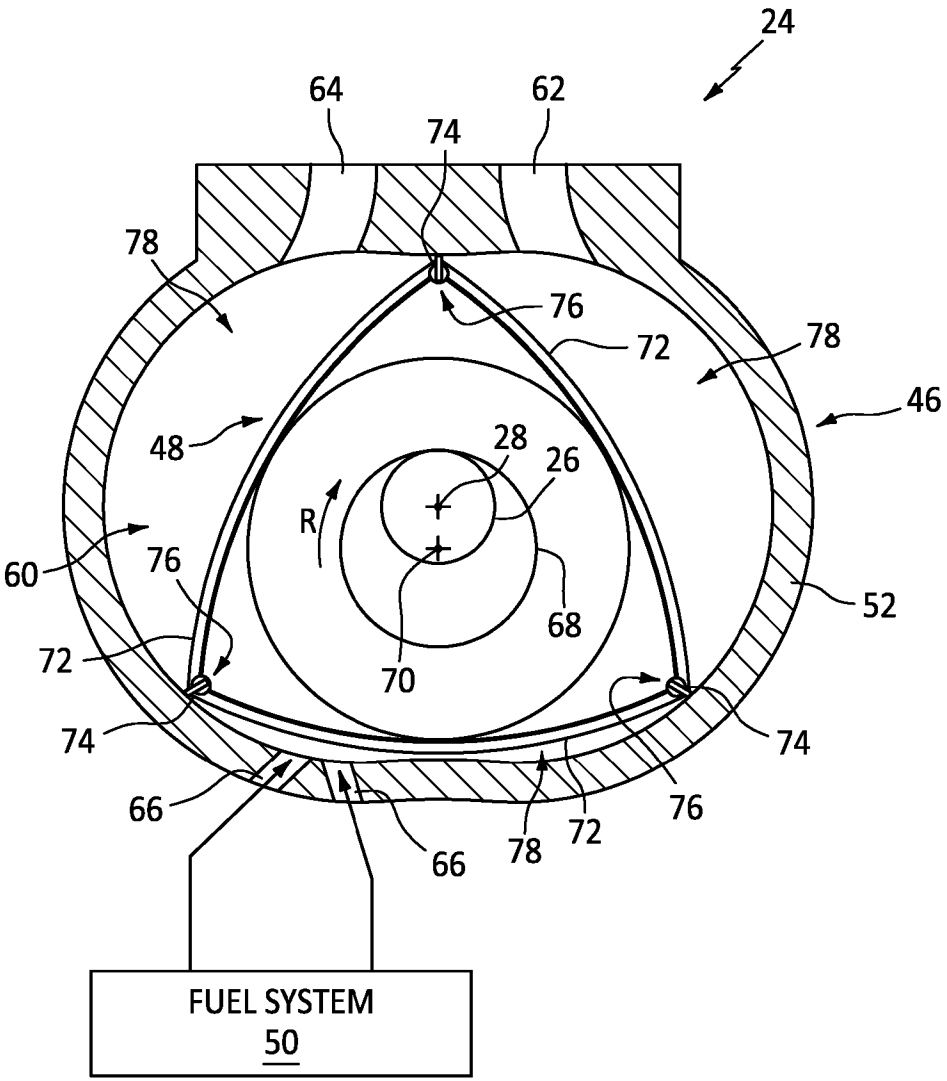
FIG. 3 illustrates a cutaway axial view of a rotor assembly for the engine assembly of FIG. 1, in accordance with one or more embodiments of the present disclosure.

Referring to FIGS. 2 and 3, the rotor assembly 24 includes a rotor housing 46, one or more rotors 48, and a fuel system 50. FIG. 2 illustrates a side, cutaway view of the rotor assembly 24. FIG. 3 illustrates a cutaway view of the rotor assembly 24 at an axial position relative to the rotational axis 28. The rotor assembly 24 of FIG. 2 includes a single rotor 48, however, the present disclosure is not limited to any particular number of rotors 48 for the rotor assembly 24. For example, the rotor assembly 24 may alternatively include a plurality of rotors 48.

The rotor housing 46 of FIGS. 2 and 3 includes a rotor housing body 52 and opposing side housing assemblies 54. The rotor housing body 52 may extend (e.g., axially extend) between and to a first end 56 of the rotor housing body 52 and a second end 58 of the rotor housing body 52. The rotor housing body 52 may extend about (e.g., completely around) the rotational axis 28. The side housing assemblies 54 may be mounted to or otherwise disposed at (e.g., on, adjacent, or proximate) the first end 56 and the second end 58. For example, the side housing assemblies 54 may include a first side housing assembly 54A disposed at the first end 56 and a second side housing assembly 54B disposed at the second end 58. Each of the first side housing assembly 54A and the second side housing assembly 54B may include a respective shaft aperture (not shown) through which the engine shaft 26 may extend along the rotational axis 28. The rotor housing body 52 and the side housing assemblies 54 form a rotor cavity 60 of the rotor assembly 24.

FIG. 3 illustrates the rotor housing body 52 surrounding and forming the rotor cavity 60. The rotor cavity 60 of FIG.

3 is formed with two lobes, which two lobes may collectively be configured with an epitrochoid shape. The rotor housing body 52 further forms an intake port 62, an exhaust portion 64, and one or more fuel system passages 66. The intake port 62 is in fluid communication with the rotor cavity 60. The intake port 62 is configured to direct compressed air to the rotor cavity 60, for example, from the compressor section 16 (see FIG. 1). The exhaust port 64 is in fluid communication with the rotor cavity 60. The exhaust port 64 is configured to direct combustion exhaust gas out of the rotor cavity 60. For example, the exhaust port 64 may be configured to direct the combustion exhaust gas from the rotor cavity 60 to the turbine section 18 (see FIG. 1). The fuel system passages 66 provide access to the rotor cavity 60 for a spark plug or other ignition device and/or for one or more fuel injectors of a fuel system 50.

The rotor 48 of FIGS. 2 and 3 is coupled to an eccentric portion 68 of the engine shaft 26. The rotor 48 is disposed within the rotor cavity 60. The rotor 48 is configured to rotate (e.g., in rotation direction R) with the eccentric portion 68 about a rotational axis 70 of the rotor 48 to perform orbital revolutions within the rotor cavity 60. The rotational axis 70 may be offset from and parallel to the rotational axis 28.

Briefly, the rotor 48 of FIG. 3 includes three sides 72 and three apex seals 74. The sides 72 of the rotor 48 form a generally triangular cross-sectional shape of the rotor 48 (e.g., along a plane extending perpendicular to the rotational axis 70). The sides 72 may be configured with a convex curvature, which convex curvature faces away from the rotational axis 70. Each side 72 intersects each other side 72 at an apex portion 76 of the rotor 48. Each apex seal 74 is disposed at a respective one of the apex portions 76. Each apex portion 76 may include a slot, channel, or other attachment configuration for retaining a respective apex seal 74. Each apex seal 74 extends outward (e.g., radially outward) from each respective apex portion 76 toward the rotor housing body 52. The apex seals 74 may be configured as spring-loaded seals, which spring-loaded seals may be biased toward an outer radial position. Each apex seal 74 is configured to sealingly contact the rotor housing body 52, thereby forming three separate working chambers 78 of variable volume between the rotor 48 and the rotor housing body 52.

In operation of the engine 12, the fuel system 50 is configured to effect rotation of the rotor 48 by directing a fuel into the rotor cavity 60 and igniting the fuel in a defined sequence. During each orbital revolution of the rotor 48, each working chamber 78 varies in volume and moves about the rotor cavity 48 to undergo four phases of intake, compression, expansion, and exhaust.

Figure 4:
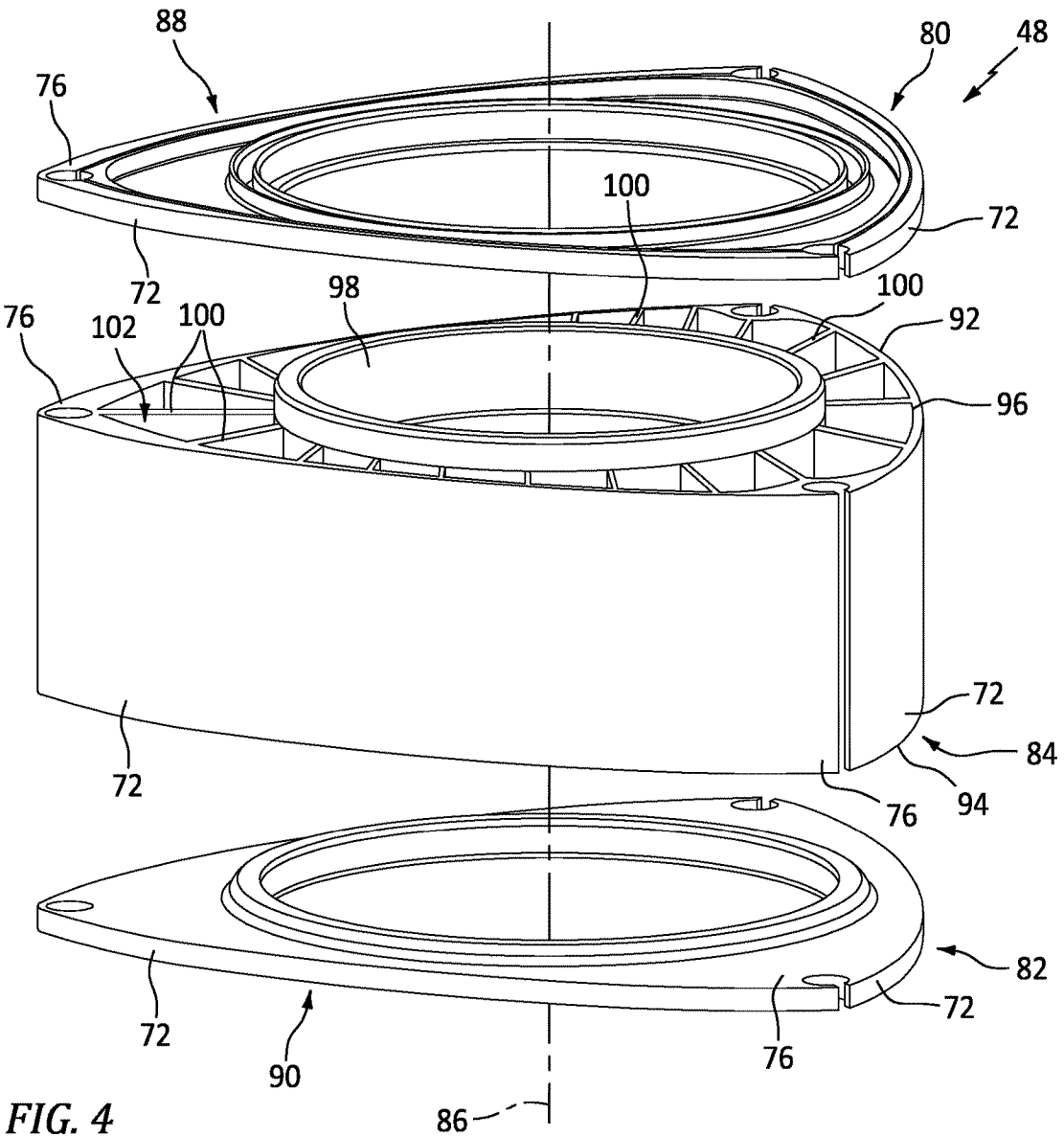
FIG. 4 illustrates an exploded, perspective view of a rotor for a rotor assembly, in accordance with one or more embodiments of the present disclosure.
Figure 5:
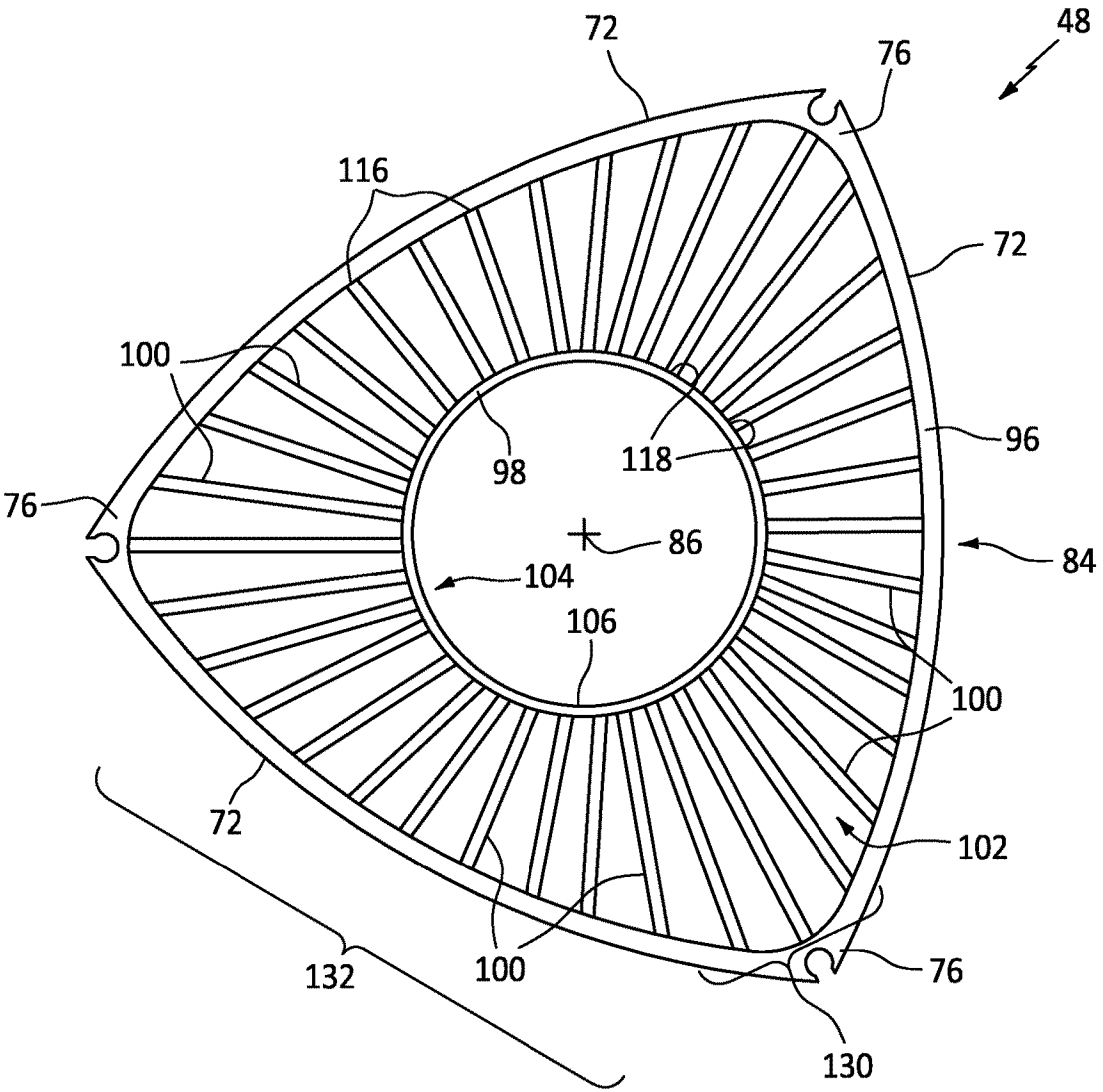
FIG. 5 illustrates a cutaway view of a portion of a rotor for a rotor assembly, in accordance with one or more embodiments of the present disclosure.

Referring to FIGS. 4-8, the rotor 48 will be described in greater detail. FIG. 4 illustrates an exploded, perspective view of the rotor 48. FIG. 5 illustrates a cutaway view of a portion of the rotor 48. The rotor 48 of FIGS. 4 and 5 includes a first end body 80, a second end body 82, and an intermediate body 84 disposed along an axial centerline 86 of the rotor 48. As will be discussed in further detail, the first end body 80, the second end body 82, and the intermediate body 84 form a single monolithic body of the rotor 48. The first end body 80 forms a first axial end 88 of the rotor 48. The first end body 80 extends about (e.g., completely around) the axial centerline 86. The first end body 80 forms a portion of the sides 72 and apex portions 76 at (e.g., on, adjacent, or proximate) the first axial end 88. The second end body 82 forms a second axial end 90 of the rotor 48. The second end body 82 extends about (e.g., completely around) the axial centerline 86. The second end body 82 forms a portion of the sides 72 and apex portions 76 at (e.g., on, adjacent, or proximate) the second axial end 90.

The intermediate body 84 extends axially between and to a first axial end 92 of the intermediate body 84 and a second axial end 94 of the intermediate body 84. The first axial end 92 is disposed at (e.g., on, adjacent, or proximate) the first end body 80. The second axial end 94 is disposed at (e.g., on, adjacent, or proximate) the second end body 82. The intermediate body 84 includes an outer body portion 96, an inner body portion 98, and a plurality of ribs 100. The intermediate body 84 forms a cavity 102 of the rotor 48 between the outer body portion 96 and the inner body portion 98. The cavity 102 is axially bounded by the first end body 80 and the second end body 82 at the first axial end 92 and the second axial end 94, respectively.

The outer body portion 96 extends axially between and to the first axial end 92 and the second axial end 94. The outer body portion 96 extends about (e.g., completely around) the axial centerline 86. The outer body portion 96 forms a portion of the sides 72 and the apex portions 76 extending from the first axial end 92 to the second axial end 94.

The inner body portion 98 extends axially between and to the first axial end 92 and the second axial end 94. The inner body portion 98 is configured as an annular body portion extending circumferentially about (e.g., completely around) the axial centerline 86. The inner body portion 98 forms a radially interior portion of the rotor 48 which surrounds the engine shaft 26 (see FIGS. 1-3). For example, the inner body portion 98 includes an inner radial side 104 which faces the engine shaft 26. The inner radial side 104 extends between and to the first axial end 92 and the second axial end 94. As shown, for example, in FIGS. 6 and 7, the inner radial side 104 may form an inner race 106 and one or more lubricant channels 108.

The inner race 106 forms a portion of a bearing assembly with the engine shaft 26, which bearing assembly may rotatably support the rotor 48 relative to the engine shaft 26 (see FIGS. 1-3). The inner race 106 includes an inner race surface 110 extending circumferentially about (e.g., completely around) the axial centerline 86. The inner race 106 may form a bearing lubricant channel 112 within the inner race surface 110. For example, the inner race 106 of FIG. 6 forms the bearing lubricant channel 112 recessed from the inner race surface 110. The bearing lubricant channel 112 may extend circumferentially about (e.g., completely around) the axial centerline 86.

Figure 6:
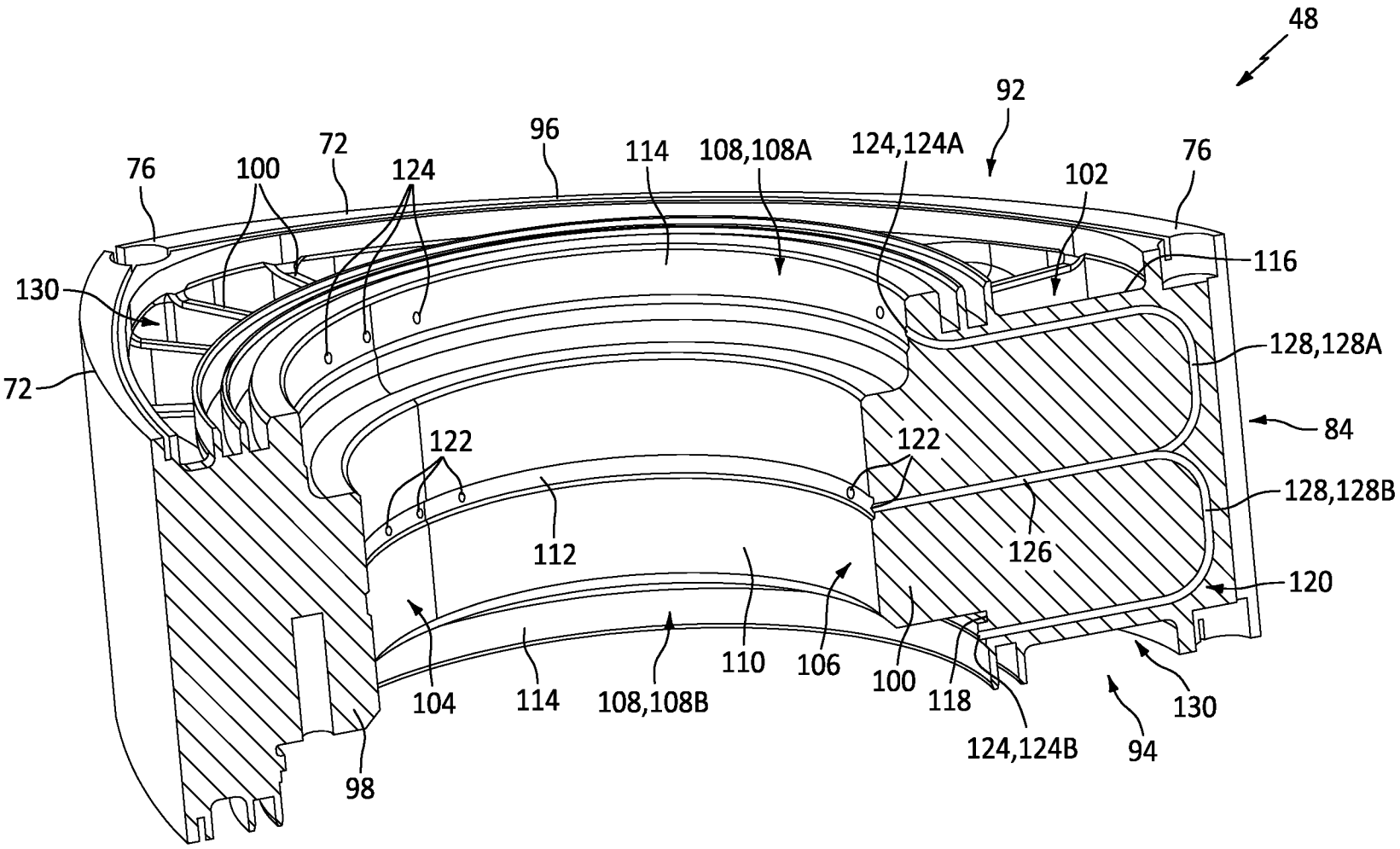
FIG. 6 illustrates a cutaway, perspective view of a portion of a rotor for a rotor assembly, in accordance with one or more embodiments of the present disclosure.
Figure 7:
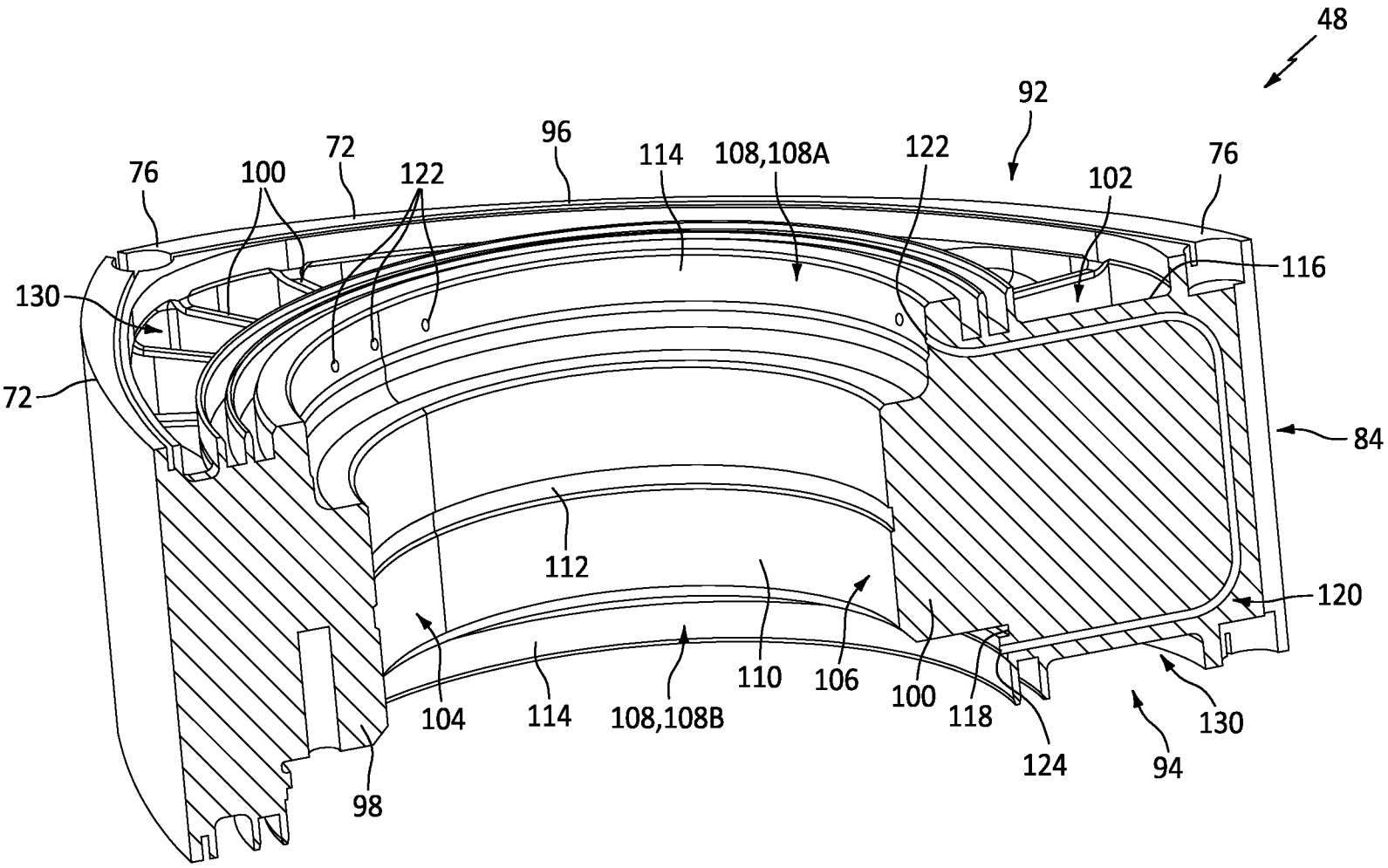
FIG. 7 illustrates a cutaway, perspective view of a portion of another rotor for a rotor assembly, in accordance with one or more embodiments of the present disclosure.

The inner radial side 104 of FIGS. 6 and 7 forms the lubricant channels 108 adjacent (e.g., axially adjacent) the inner race 106. For example, the inner radial side 104 of FIGS. 6 and 7 forms a first lubricant channel 108A at (e.g., on, adjacent, or proximate) the first axial end 92 and a second lubricant channel 108B at (e.g., on, adjacent, or proximate) the second axial end 94. Each of the first lubricant channel 108 A and the second lubricant channel 108B are disposed axially adjacent the inner race 106 (e.g., on opposing axial sides of the inner race 106). The inner radial side 104 forms a channel surface 114 of the lubricant channels 108, which channel surface 114 forms a portion of a respective one of the lubricant channels 108. The channel surface of FIG. 6 is radially offset from (e.g., radially outward of) the inner race surface 110.

The plurality of ribs 100 are disposed within the cavity 102 radially between the outer body portion 96 and the inner body portion 98. For example, the plurality of ribs 100 may extend between and connect the outer body portion 96 and the inner body portion 98. Each of the plurality of ribs 100 of FIG. 5 extends (e.g., radially extends) between and to an outer radial end 116 of the respective rib 100 and an inner radial end 118 of the respective rib 100. The outer radial end 116 is connected to or otherwise disposed at (e.g., on, adjacent, or proximate) the outer body portion 96. The inner radial end 118 is connected to or otherwise disposed at (e.g., on, adjacent, or proximate) the inner body portion 98. Each of the plurality of ribs 100 may extend all or a portion of an axial distance from the first axial end 92 to the second axial end 94. For example, each of the plurality of ribs 100 may extend between and connect the first end body 80 and the second end body 82. The plurality of ribs 100 of FIG. 5 are illustrated as extending linearly (e.g., in a radial direction) between the outer body portion 96 and the inner body portion 98, however, the present disclosure is not limited to linear configurations of the plurality of ribs 100. For example, the plurality of ribs 100 may be configured with complex geometrical shapes (e.g., fir tree configurations, capillary configurations, etc.) to facilitate suitable stiffness and cooling characteristics of the rotor 48.

The intermediate body 84 forms one or more lubricant passages 120 within the outer body portion 96, the inner body portion 98, and/or the plurality of ribs 100. As shown in FIGS. 6 and 7, for example, each of the lubricant passages 120 may be formed by and extend through the outer body portion 96, the inner body portion 98, and/or at least one of the plurality of ribs 100. Each of the lubricant passages 120 includes at least one inlet 122 and at least one outlet 124. Each of the lubricant passages 120 is configured to direct a lubricant from the at least one inlet 122 to the at least one outlet 124. The at least one inlet 122 may be disposed at (e.g., on, adjacent, or proximate) the inner body portion 98.

FIG. 6 illustrates a cutaway view of the rotor 48 illustrating a configuration of the lubricant passages 120 formed within one of the plurality of ribs 100. The at least one inlet 122 of FIG. 6 is disposed at (e.g., on, adjacent, or proximate) the inner race 106 (e.g., within the bearing lubricant channel). The at least one outlet 124 may be disposed at (e.g., on, adjacent, or proximate) the inner body portion 98. For example, the at least one outlet 124 of FIG. 6 includes a first outlet 124A disposed at (e.g., on, adjacent, or proximate) the first lubricant channel 108A (e.g., the channel surface 114) and a second outlet 124B disposed at (e.g., on, adjacent, or proximate) the second lubricant channel 108B (e.g., the channel surface 114). The lubricant passages 120 of the present disclosure, however, are not limited to any particular location of the at least one inlet 122 or the at least one outlet 124. As shown in FIG. 6, for example, the lubricant passage may extend from the at least one inlet 122 at the inner body portion 98, through one of the plurality of ribs 100, into the outer body portion 96, and then back through the one of the plurality of ribs 100 and the inner body portion 98 to the at least one outlet 124 at the inner body portion 98. The extended length of the lubricant passage 120 through the outer body portion 96, the inner body portion 98, and the plurality of ribs 100 may facilitate improved cooling effectiveness of the lubricant directed through the lubricant passage 120.

FIG. 7 illustrates a cutaway view of the rotor 48 illustrating another configuration of the lubricant passages 120 formed within one of the plurality of ribs 100. The lubricant passage 120 of FIG. 7 extends from the at least one inlet 122 through the inner body portion 98, the one of the plurality of ribs 100, and the outer body portion 96 and then back through the one of the plurality of ribs 100 and the inner body portion 98 to the at least one outlet 124. The at least one inlet 122 is disposed in the inner body portion 98 at (e.g., on, adjacent, or proximate) the first axial end 92 (e.g., at the first lubricant channel 108A). The at least one outlet 124 is disposed in the inner body portion 98 at (e.g., on, adjacent, or proximate) the second axial end 94 (e.g., at the second lubricant channel 108B).

Figure 8:
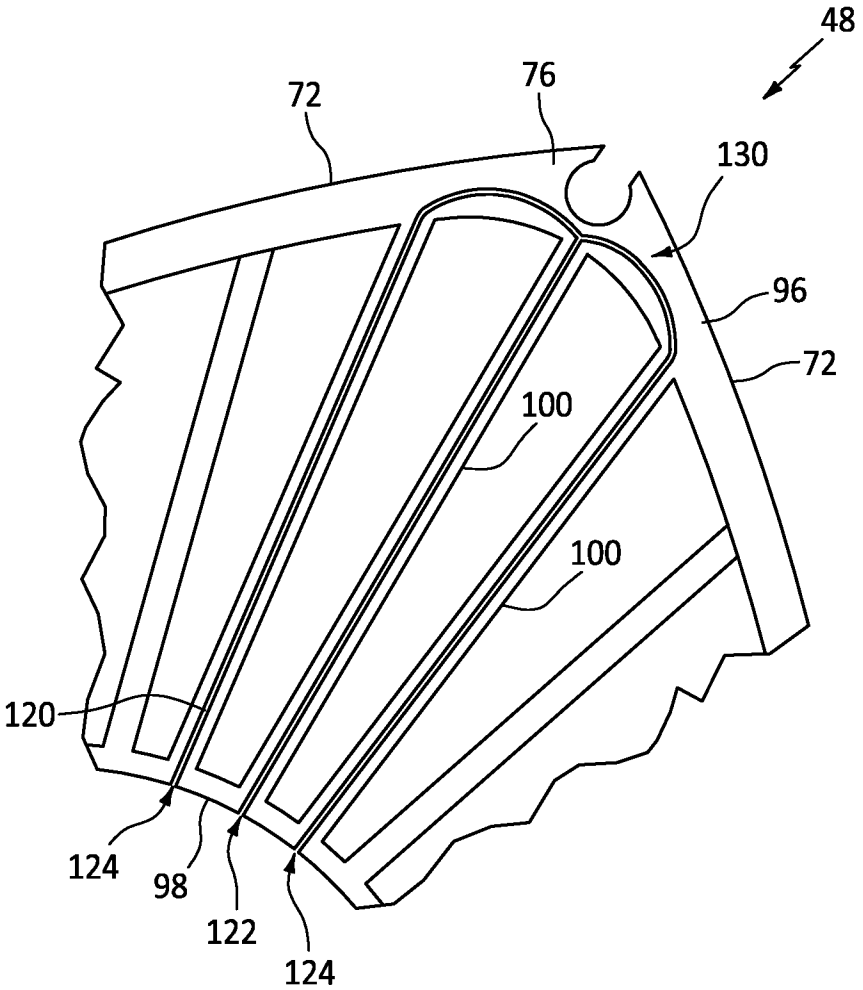
FIG. 8 illustrates a cutaway view of a portion of a rotor for a rotor assembly, in accordance with one or more embodiments of the present disclosure.

As shown in FIG. 8, the lubricant passage 120 may be formed by an extend through more than one of the plurality of ribs 100. For example, in a direction from the at least one inlet 122 to the at least one outlet 124, the lubricant passage 120 may extend through a first of the plurality of ribs 100 and then through one or more of the plurality of ribs 100 which are disposed circumferentially adjacent the first of the plurality of ribs 100. Of course, the lubricant passage 120 of FIG. 8 is provided as an example, and the present disclosure is not limited to the lubricant passage 120 configuration of FIG. 8.

The lubricant passage 120 may include one or more inlet branches 126 and one or more outlet branches 128. The inlet branches 126 extend from a respective one of the at least one inlet 122 to the outlet branches 128. The outlet branches 128 extend from the inlet branches 126 to a respective one of the at least one outlet 124. For example, the lubricant passage 120 of FIG. 6 includes a first outlet branch 128A extending from the inlet branch 126 to the first outlet 124A and a second outlet branch 128B extending from the inlet branch 126 to the second outlet 124B. However, the lubricant passages 120 of the present disclosure are not limited to this particular configuration of the inlet branches 126 and the outlet branches 128.

The lubricant passages 120 may be positioned at the apex portions 76. For example, the lubricant passages 120 may be positioned in the intermediate body 84 at (e.g., on, adjacent, or proximate) circumferential locations of the apex portions 76. The lubricant passages 120 may extend through a cooled subset 130 of the plurality of ribs 100. The cooled subset 130 of the plurality of ribs 100 may be disposed at (e.g., on, adjacent, or proximate) the circumferential locations of the apex portions 76. The Plurality of ribs 100 may additionally include an uncooled subset 132 of the plurality of ribs 100. The uncooled subset 132 of the plurality of ribs 100 may not include the lubricant passages 120. The uncooled subset 132 of the plurality of ribs 100 may be disposed along circumferential portions of the intermediate body 84 other than those circumferential portions including the apex portions 76. The location of the lubricant passages 120 at the apex portions 76 may facilitate greater cooling of the intermediate body 84 in proximity to the apex seals 74 where cooling needs of the rotor 48 may be greatest. Providing the lubricant passages 120 for the cooled subset 130 of the plurality of ribs 100 and not for the uncooled subset 132 of the plurality of ribs facilitates a reduction in lubricant and cooling needed for the rotor 48.

During operation of the rotor assembly 24, a lubricant (e.g., oil) is directed through and/or along the engine shaft 26 to the rotor 48. For example, the lubricant may be directed to the inner race 106 for lubrication and cooling of the inner race surface 110. At least some of the lubricant may be directed into the bearing lubricant channel 112 and into the at least one inlet 122 for each of the lubricant passages 120. The lubricant is directed through the lubricant passages 120 from the at least one inlet 122 to the at least one outlet 124, thereby providing cooling for the rotor 48.

Figure 9:
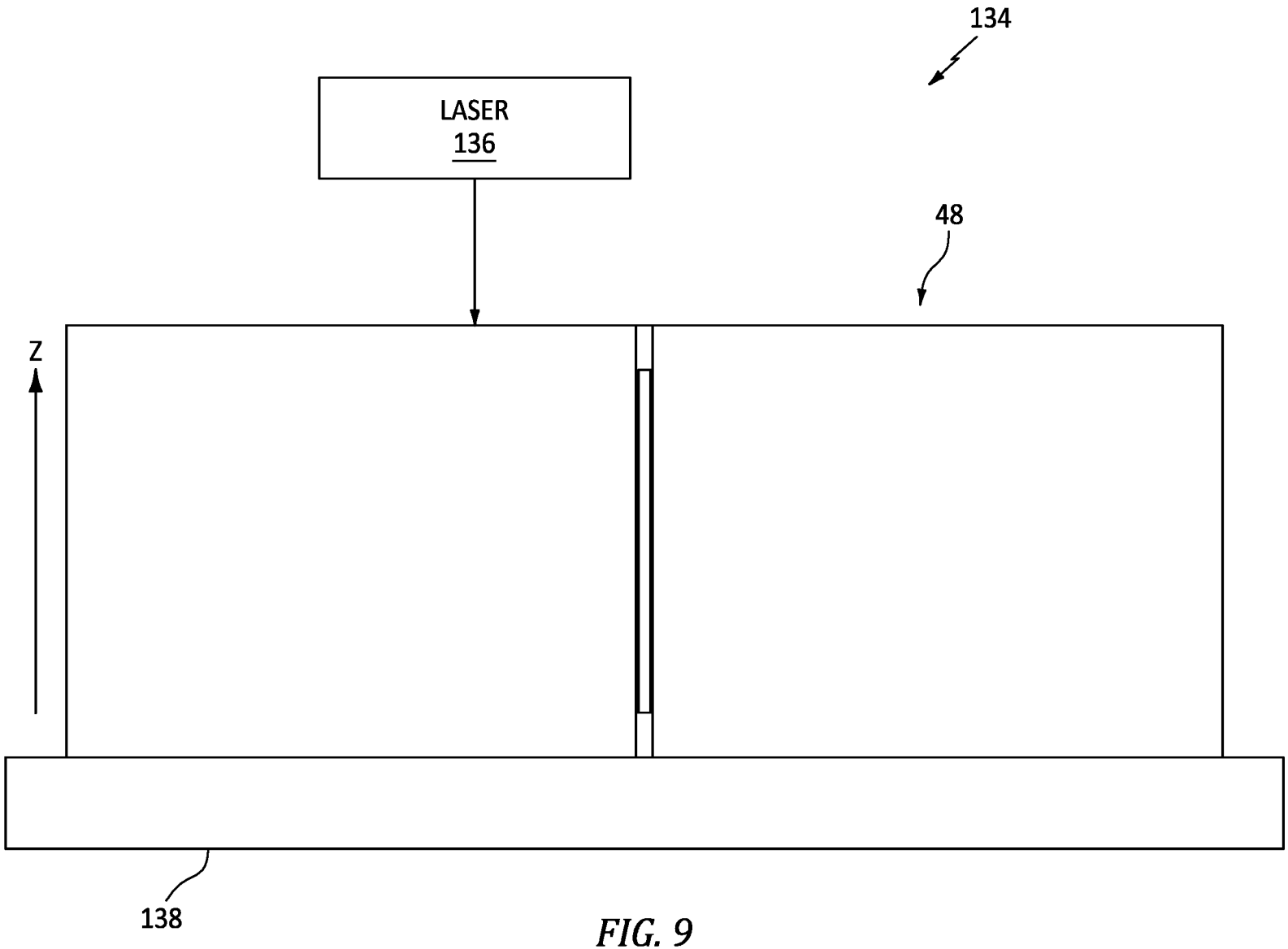
FIG. 9 illustrates a side of an additive manufacturing assembly and a rotor for a rotor assembly, in accordance with one or more embodiments of the present disclosure.

Referring to FIG. 9, the rotor 48 may be manufactured using an additive manufacturing process. For example, the rotor 48 may be manufactured using a laser powder bed fusion manufacturing process or another suitable additive manufacturing process conventionally known in the art.

FIG. 9 schematically illustrates an exemplary additive manufacturing assembly 134 including a laser generator 136 and a print bed 138. The rotor 48 may be additively manufactured layer by layer on the print bed 138 by the laser generator 136 (e.g., by melting a metal or metal alloy powder) in the print direction Z to form the single monolithic body of the rotor 48. The axial centerline 86 of the rotor 48 may be parallel or substantially parallel to the print direction Z. For at least some configurations of the intermediate body 84 and lubricant passages 120, conventional machining practices may be unsuitable for manufacturing the intermediate body 84. Accordingly, an additive manufacturing process for forming the rotor 48 may be used to overcome the shortcomings of these conventional machining practices.

While the principles of the disclosure have been described above in connection with specific apparatuses and methods, it is to be clearly understood that this description is made only by way of example and not as limitation on the scope of the disclosure. Specific details are given in the above description to provide a thorough understanding of the embodiments. However, it is understood that the embodiments may be practiced without these specific details.

It is noted that the embodiments may be described as a process which is depicted as a flowchart, a flow diagram, a block diagram, etc. Although any one of these structures may describe the operations as a sequential process, many of the operations can be performed in parallel or concurrently. In addition, the order of the operations may be rearranged. A process may correspond to a method, a function, a procedure, a subroutine, a subprogram, etc.

The singular forms "a," "an," and "the" refer to one or more than one, unless the context clearly dictates otherwise. For example, the term "comprising a specimen" includes single or plural specimens and is considered equivalent to the phrase "comprising at least one specimen." The term "or" refers to a single element of stated alternative elements or a combination of two or more elements unless the context clearly indicates otherwise. As used herein, "comprises" means "includes." Thus, "comprising A or B," means "including A or B, or A and B," without excluding additional elements.

It is noted that various connections are set forth between elements in the present description and drawings (the contents of which are included in this disclosure by way of reference). It is noted that these connections are general and, unless specified otherwise, may be direct or indirect and that this specification is not intended to be limiting in this respect. Any reference to attached, fixed, connected, or the like may include permanent, removable, temporary, partial, full and/or any other possible attachment option.

No element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprise", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. For example, in the exemplary embodiments described above within the Detailed Description portion of the present specification, elements may be described as individual units and shown as independent of one another to facilitate the description. In alternative embodiments, such elements may be configured as combined elements.

The invention claimed is:

1. A rotor for an aircraft rotary engine, the rotor comprising:

a rotor body extending about an axial centerline, the rotor body including:

an outer body portion forming a plurality of sides and a plurality of apex portions of the rotor, each side of the plurality of sides intersecting each other side of the plurality of sides at one of the plurality of apex portions;

an annular inner body portion disposed radially inward of the outer body portion; and ribs extending radially between and connecting the outer body portion and the annular inner body portion;

the rotor body forming at least a first lubrication passage within the inner body portion and within a first rib of the ribs, the first lubrication passage including at least one passage inlet and at least one passage outlet, the at least one passage inlet disposed at the annular inner body portion;

wherein the rotor body forms the first lubrication passage within the first rib and within at least one second rib of the ribs.

2. The rotor of claim 1, wherein the rotor body further forms the first lubrication passage within the outer body portion.

3. The rotor of claim 1, wherein the at least one passage outlet is disposed at the annular inner body portion.

4. The rotor of claim 1, wherein the annular inner body portion extends between and to a first axial side and a second axial side, the at least one passage inlet disposed at the first axial side and the at least one passage outlet disposed at the second axial side.

5. The rotor of claim 1, wherein the at least one passage outlet includes a first passage outlet and a second passage outlet.

6. The rotor of claim 5, wherein:

the first lubrication passage includes an inlet branch, a first outlet branch, and a second outlet branch; and the inlet branch extends from the at least one passage inlet to the first outlet branch and the second outlet branch, the first outlet branch extends from the inlet branch to the first passage outlet, and the second outlet branch extends from the inlet branch to the second passage outlet.

7. The rotor of claim 1, wherein the first lubrication passage is disposed at a circumferential location of a respective one of the plurality of apex portions.

8. The rotor of claim 7, wherein the plurality of ribs includes a cooled subset of the plurality of ribs and an uncooled subset of the plurality of ribs, the cooled subset of the plurality of ribs forming the first lubrication passage.

9. The rotor of claim 1, wherein the annular inner body portion forms a bearing inner race of the rotor, the bearing inner race including an inner race surface.

10. The rotor of claim 9, wherein the bearing inner race forms a bearing lubricant channel within the inner race surface, the at least one inlet disposed at the bearing lubricant channel.

11. A rotary engine assembly for an aircraft, the rotary engine assembly comprising:

a rotatable engine shaft; and at least one rotor coupled to an eccentric portion of the rotatable engine shaft, each rotor of the at least one rotor including:

a rotor body extending about an axial centerline, the rotor body including:

an outer body portion;

an annular inner body portion disposed radially inward of the outer body portion; and ribs extending radially between and connecting the outer body portion and the annular inner body portion;

the rotor body forming at least a first lubrication passage within the inner body portion and within a first rib of the ribs, the first lubrication passage including at least one passage inlet and at least one passage outlet, the at least one passage inlet disposed at the annular inner body portion;

wherein the annular inner body portion forms a bearing inner race of the rotor, the bearing inner race including an inner race surface facing the rotatable engine shaft; and wherein the bearing inner race forms a bearing lubricant channel within the inner race surface, the at least one inlet disposed at the bearing lubricant channel.

12. The rotary engine assembly of claim 11, wherein the first lubrication passage is formed by the first rib and at least one second rib of the ribs, the first lubrication passage extending through the first rib and the at least one second rib from the at least one inlet to the at least one outlet.

13. A rotor for an aircraft rotary engine, the rotor comprising:

a rotor body extending about an axial centerline, the rotor body including:

an outer body portion forming a plurality of sides and a plurality of apex portions of the rotor, each side of the plurality of sides intersecting each other side of the plurality of sides at one of the plurality of apex portions;

an annular inner body portion disposed radially inward of the outer body portion; and ribs extending radially between and connecting the outer body portion and the annular inner body portion;

the rotor body forming at least a first lubrication passage within the inner body portion and within a first rib of the ribs, the first lubrication passage including at least one passage inlet and at least one passage outlet, the at least one passage inlet disposed at the annular inner body portion;

wherein:

the at least one passage outlet includes a first passage outlet and a second passage outlet;

the first lubrication passage includes an inlet branch, a first outlet branch, and a second outlet branch; and the inlet branch extends from the at least one passage inlet to the first outlet branch and the second outlet branch, the first outlet branch extends from the inlet branch to the first passage outlet, and the second outlet branch extends from the inlet branch to the second passage outlet.

* * * * *